US008282019B2

(12) United States Patent
Karimi Esfahani et al.

(10) Patent No.: US 8,282,019 B2
(45) Date of Patent: Oct. 9, 2012

(54) ADJUSTABLE COLD SPRAY NOZZLE

(75) Inventors: Mohammad Karimi Esfahani, Windsor (CA); Daniel P. Vanderzwet, Omemee (CA)

(73) Assignee: Doben Limited, Windsor (CA)

( * ) Notice: Subject to any disclaimer, the term of this patent is extended or adjusted under 35 U.S.C. 154(b) by 528 days.

(21) Appl. No.: 12/525,687

(22) PCT Filed: Feb. 12, 2007

(86) PCT No.: PCT/CA2007/000200

§ 371 (c)(1),
(2), (4) Date: Aug. 4, 2009

(87) PCT Pub. No.: WO2008/098336

PCT Pub. Date: Aug. 21, 2008

(65) Prior Publication Data

US 2010/0108776 A1 May 6, 2010

(51) Int. Cl.
*A62C 5/02* (2006.01)

(52) U.S. Cl. ..... 239/8; 239/79; 239/81; 239/422; 239/423; 239/433; 239/589; 427/446

(58) Field of Classification Search ..... 239/1, 8, 239/79, 81, 398, 422, 423, 433, 589; 427/446
See application file for complete search history.

(56) References Cited

U.S. PATENT DOCUMENTS 5,302,414 A 4/1994 Alkhimov et al.
5,713,285 A 2/1998 Reed et al.
6,139,913 A * 10/2000 Van Steenkiste et al. ..... 427/191
6,283,386 B1 * 9/2001 Van Steenkiste et al. ..... 239/79
6,502,767 B2 1/2003 Kay et al.
6,972,138 B2 12/2005 Heinrich
7,101,120 B2 9/2006 Jurkovich
7,143,967 B2 12/2006 Heinrich et al.
7,475,831 B2 * 1/2009 Van Steenkiste et al. ..... 239/589
2002/0071906 A1 6/2002 Rusch
2004/0166247 A1 8/2004 Heinrich et al.
2006/0201418 A1 9/2006 Ko et al.

OTHER PUBLICATIONS

Search Report and Written Opinion mailed on Nov. 13, 2007 for PCT/CA2007/000200.
Notification of Transmittal of International Preliminary Report on Patentability mailed on May 26, 2009 for PCT/CA2007/000200.

* cited by examiner

*Primary Examiner* — Steven J Ganey
(74) *Attorney, Agent, or Firm* — Carlson, Gaskey & Olds, P.C.

(57) ABSTRACT

A cold spray nozzle assembly includes a venturi having converging and diverging portions interconnected at a throat. An air supply conduit is in communication with the venturi for supplying a carrier gas to the converging portion. A powder feed tube is in communication with the venturi for supplying a powder material. An adjustment member is arranged within the venturi and is axially moveable relative thereto between multiple positions. The multiple positions respectively provide multiple different areas or throat clearances including a desired area between the adjustment member and the venturi or throat clearance. As a result, the adjustment member can be axially positioned to achieve desired gas pressures, deposition rates, and accommodate machining tolerances and component wear based upon the selected area. A retention member maintains the adjustment member in the desired position during operation of the cold spray nozzle assembly.

14 Claims, 3 Drawing Sheets

ADJUSTABLE COLD SPRAY NOZZLE

This application is a United States National Phase application of PCT Application No. PCT/CA2007/0002000 filed Feb. 12, 2007.

BACKGROUND

This application relates to a cold spray nozzle assembly used in a cold spray system that deposits a metallic powder, for example, onto a substrate.

Cold spray technology is being developed to deposit metallic powder onto a substrate using a generally low temperature carrier gas. The carrier gas flows through a venturi, typically provided in a cold spray nozzle assembly, to accelerate powdered material through the venturi to a desired velocity for deposition onto a substrate.

Many different cold spray nozzle assemblies and venturi geometries have been proposed in the prior art. Unfortunately, most of the prior art arrangements fail to provide a cold spray nozzle assembly that is commercially feasible. For example, it is desirable to switch between various powdered materials depending upon the application, which requires a different venturi or nozzle assembly based upon the application. Furthermore, it may be desirable to vary the gas pressure or deposition rate for a particular application, which requires components within the nozzle assembly to be changed.

A commercial nozzle assembly must accommodate machining tolerances in the assembled spray nozzle. Moreover, the internal surfaces of the spray nozzle wear from the typically abrasive powder material. What is needed is a cold spray nozzle assembly that can achieve different gas pressures, deposition rates, accommodate various powder materials and tolerance issues relating to machining and component wear.

SUMMARY

A cold spray nozzle assembly includes a venturi having converging and diverging portions interconnected at a throat. An air supply conduit is in communication with the venturi for supplying a carrier gas to the converging portion. A powder feed tube is in communication with the venturi for supplying a powder material. An adjustment member is arranged within the venturi and is axially moveable relative thereto between multiple positions, including a desired position. The multiple positions respectively provide multiple different areas including a desired area between the adjustment member and the venturi. As a result, the adjustment member can be axially positioned to achieve desired gas pressures, deposition rates, and accommodate machining tolerances and component wear based upon the selected area. A retention member maintains the adjustment member in the desired position during operation of the cold spray nozzle assembly.

In one example, the adjustment member provides the powder feeder, which includes a passage that delivers the powder material axially within the venturi. In another example, the powder feeder includes multiple circumferentially arranged passages radially offset from the longitudinal axis of the venturi. In the example, the passages are angled radially outward in the downstream direction and terminate at a tapered end of the powder feeder. The powder material can also be delivered downstream from the adjustment member or within the converging portion in other examples.

In one example, the cold spray nozzle assembly is provided by securing a nozzle tube to an orifice body. Together, the nozzle tube and orifice body respectively provide the diverging and converging portions. The orifice body is secured to a gas adapter with a nut, which permits easy assembly and disassembly of the nozzle assembly. The gas adapter provides an inlet for the carrier gas to the venturi and supports the adjustment member. The adjustment member is threaded into and out of the gas adapter to obtain the desired axial position and then locked into place using a nut.

These and other features of the present application can be best understood from the following specification and drawings, the following of which is a brief description.

DETAILED DESCRIPTION OF THE PREFERRED EMBODIMENT

Figure 1:
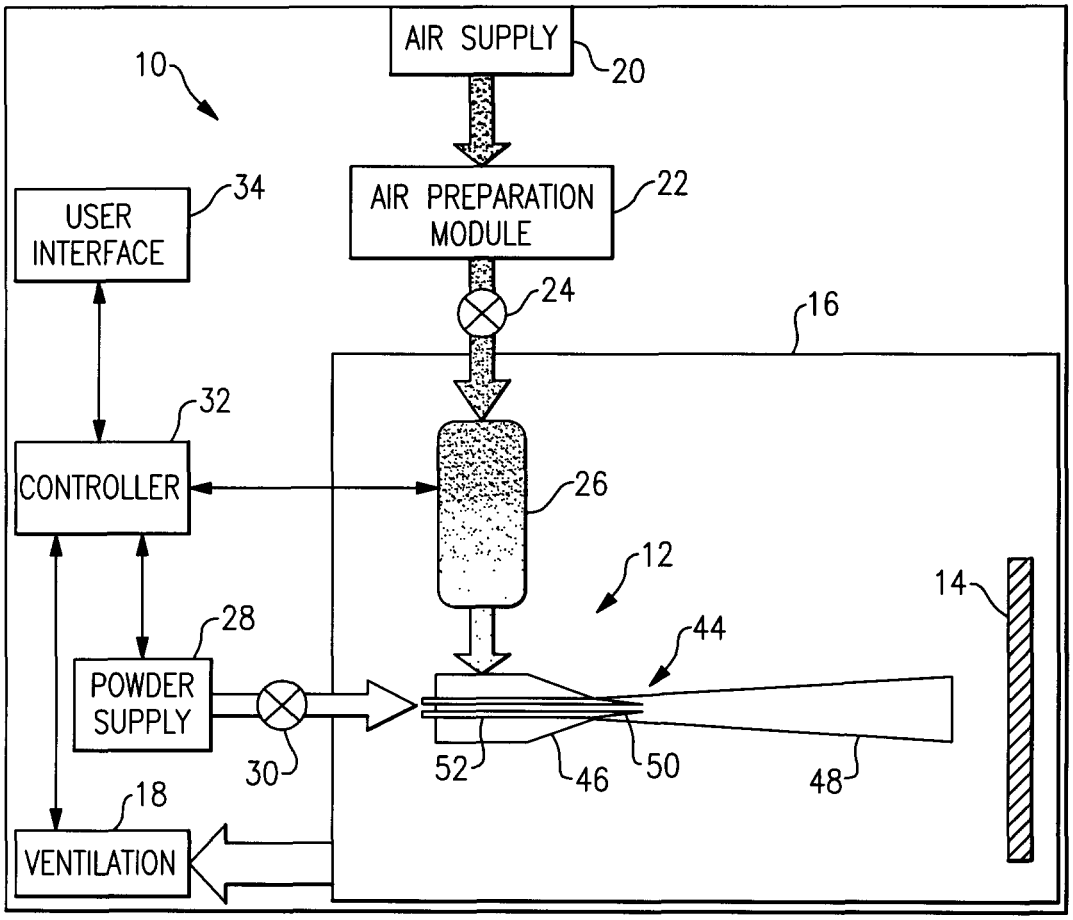
FIG. 1 is a schematic view of a cold spray system including a cold spray nozzle assembly.

A cold spray system 10 is shown in FIG. 1. The system 10 includes a cold spray nozzle assembly 12 for delivering a powder material to a substrate 14. The schematic arrangement depicted in FIG. 1 provides a cabinet 16 with a ventilation system 18 for depositing the powder material onto the substrate 14 in a controlled environment.

An air supply 20 provides a carrier gas to the nozzle assembly 12 through an air preparation module 22 that filters and conditions the carrier gas, which is typically air. The air supply 20 may supply other carrier gases, if desired. A valve 24 regulates the flow of carrier gas into the nozzle assembly. A heater 26 is regulated by controller 32 and heats the carrier gas to a desired temperature prior to entering the nozzle assembly 12. A powder supply 28 provides a powder material to the nozzle assembly 12 through a valve 30. The controller 32 regulates the supply of powder material to the nozzle assembly 12 in response to parameters input at a user interface 34. The system 10 shown in FIG. 1 is exemplary in nature and may include additional components or may omit components depicted in the Figure.

Figure 2:
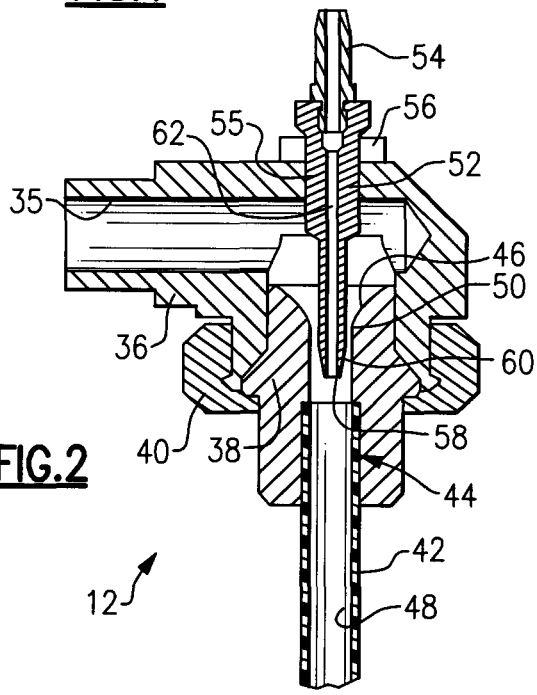
FIG. 2 is a cross-sectional view of an example cold spray nozzle assembly.

An example nozzle assembly 12 is shown in FIG. 2 in more detail. The nozzle assembly 12 includes a gas adapter 36 for supplying the carrier gas through an air supply conduit 35 to a venturi 44. An orifice body 38 is secured to the gas adapter 36 using a nut 40. A nozzle tube 42 is secured to the orifice body 38 using any suitable means, for example, a press fit or threaded connection. In one example, the nozzle tube 42 is manufactured using a hydroforming process, which provides an inexpensive method of manufacturing a portion of the tapered diverging section of the venturi 44.

A typical venturi 44 includes converging and diverging portions 46, 48 that are connected by a throat 50. In the example shown, the converging portion 46, the throat 50 and a portion of the diverging portion 48 are provided by the orifice body 38. In the example, much of the diverging portion 48 is provided by the nozzle tube 42.

The performance of the nozzle assembly 12 may vary due to machining tolerances and tolerance stack-up of the components within the nozzle assembly 12. Moreover, the surfaces of the venturi 44 wear as the powder material abrades its surfaces during use of the nozzle assembly 12. To address these issues, the nozzle assembly 12 includes an adjustment member 52 that is arranged within the venturi 44.

Figure 10:
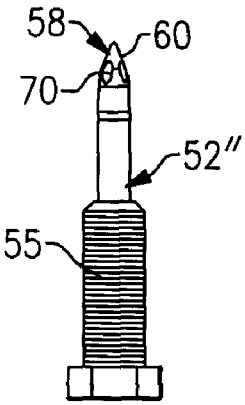
FIG. 10 is a side view of the adjustment member in FIG. 9.

In the example shown in FIGS. 2-6, the adjustment member 52 provides a powder feeder through which powder material is delivered into the venturi 44 for acceleration by the carrier gas there through. Referring to FIG. 2, the adjustment member 52 includes a hose 54 connected thereto for supplying powder material from the powder supply 28 to the venturi 44. The adjustment member 52 is adjustable between multiple axial positions (P1 and P2 in FIGS. 4 and 5) to vary the area between the adjustment member 52 and the venturi 44 or the length of the straight portion at the location of the minimum passage area, to be called throat clearance. In one example, the adjustment member 52 includes a threaded surface 55 (best shown in FIGS. 2 and 10) that permits the adjustment member 52 to be screwed into and out of the orifice body 38 to a desired axial position. The adjustment member 52 can then be retained in the desired position using a retention member such as a nut 56 (FIG. 2).

Figure 3:
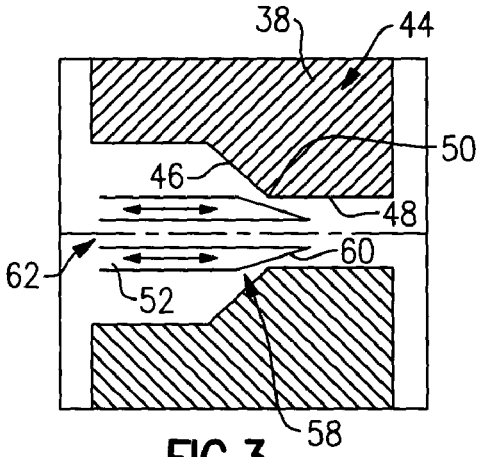
FIG. 3 is a schematic view of an adjustment member positioned relative to a venturi.

Referring to FIG. 3, one example adjustment member 52 includes a tapered surface 60 at its end 58. The tapered surface 60 provides a transition for the carrier gas entering the throat 50 and/or diverging portion 48. The tapered surface 60 may be rough for promoting mixing between the carrier gas and powder material.

In one example, the adjustment member 52 is axially positioned to obtain the desired area producing a desired gas pressure and deposition rate for a particular material. In one example the desired area corresponds to the smallest area provided between the adjustment member 52 and the venturi 44. In FIG. 3, the smallest area corresponds to the area between the throat 50 and the tapered surface 60.

Figure 4:
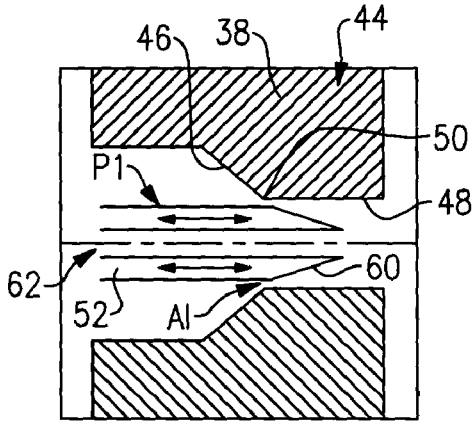
FIGS. 4 and 5 are schematic views of an adjustment member respectively in first and second positions corresponding to first and second areas.
Figure 5:
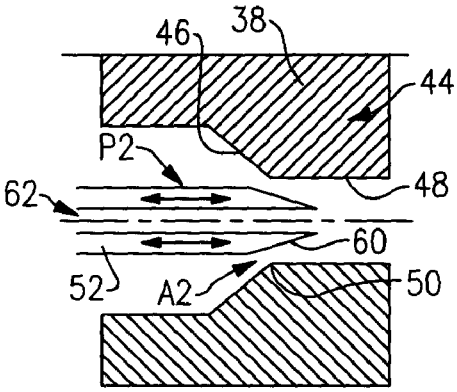
Figure 6:
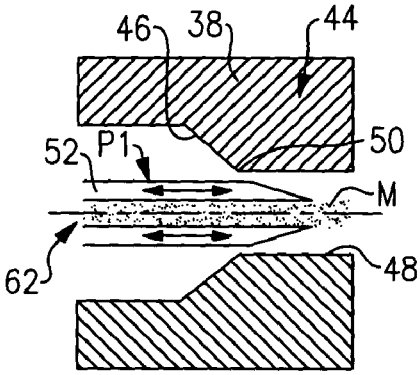
FIG. 6 is a schematic view of the adjustment member shown in FIG. 4 in which the adjustment member provides a powder feeder delivering powder material.
Figure 9:
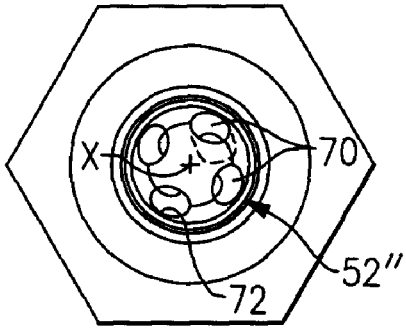
FIG. 9 is an end view of another adjustment member with canted powder feed holes radially offset from a venturi axis.

FIGS. 4 and 5 illustrate the adjustment member 52 in first and second axial positions P1, P2, which respectively correspond to first and second areas. In FIG. 4, the smallest area, labeled as A1, corresponds to the area between a cylindrical portion of the adjustment member 52 upstream from the tapered surface 60 and the throat 50. In FIG. 5, the smallest area, which is labeled as A2, corresponds to the area between the throat 50 and the tapered surface 60. Referring to FIG. 6, the adjustment member 52 provides the powder feed tube. Powder material M is delivered through a passage 62.

Figure 7:
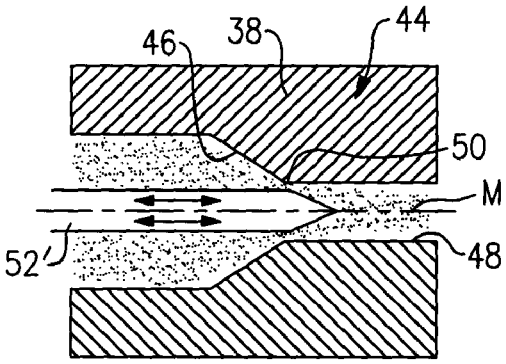
FIG. 7 is a schematic view of an adjustment member with powder material delivered upstream from a diverging portion of the venturi.

Powder material can be introduced into the venturi 44 in ways other than that shown in FIG. 6. For example, the powder material M can be introduced to the venturi 44 upstream from the end 58 at or behind the converging portion 46. In the example shown in FIGS. 7 and 8, the adjustment member 52' does not include a passage.

Figure 8:
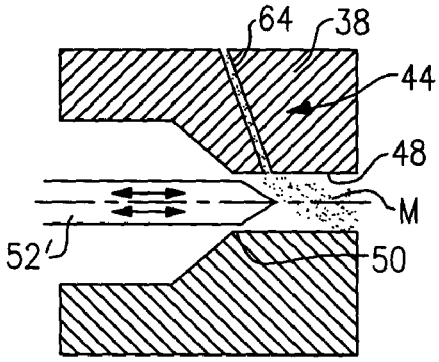
FIG. 8 is a schematic view of the adjustment member with the powder material introduced in the diverging portion of the venturi downstream from the adjustment member.

Referring to FIG. 8, the orifice body 38 includes a powder delivery passage 64 for introducing powder material M upstream from the diverging portion 44.

Figure 11:
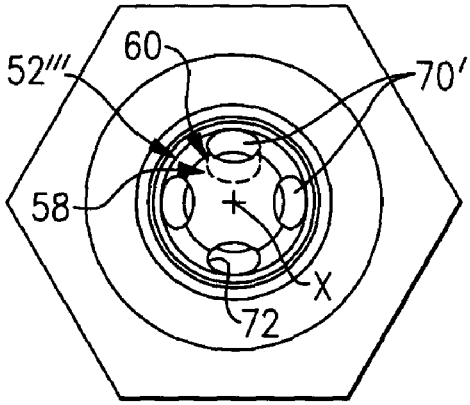
FIG. 11 is an end view of another adjustment member with the straight powder feed holes.
Figure 12:
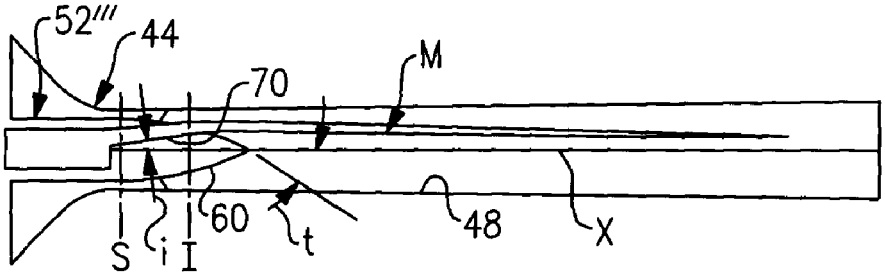
FIG. 12 is a schematic cross-sectional view of the adjustment member shown in FIG. 9 illustrating delivery of powder through one of the powder feed holes.

Other example adjustment members 52" and 52'" are shown in FIGS. 9-12. In these examples, multiple passages 70 with openings 72 are arranged circumferentially about the end 58 at the tapered surface 60, in one example. The multiple passages 70 can be angled both away from the axis X of the venturi 44 (radially outward in the downstream direction) and tangentially directed (FIGS. 9 and 10), or angled away from the axis X and straight (FIG. 11). As best seen in FIG. 12, the passages 70 are not concentric with the axis X and are at an angle relative to the axis X so that the powder material M is directed initially away from the axis X and toward the walls of the diverging portion 48. In one example, the angle of entry is selected based on the powder material M density to provide some swirl and momentum that will result in a particle flight path that minimizes the incidence of impact with the venturi 44.

Referring to FIG. 12, the relationship between the adjustment member 52 and passage 70 geometry is shown. A description of the variables used are as follows:

Main flow stream cross-sectional area at location S: AS

Main flow stream cross-sectional area at location I: AI

Specific heat ratio of the main flow stream gas: $\gamma_m$ (equal to 1.4 for air and most diatomic ideal gases, 1.67 for helium and most monatomic ideal gases).

Mach number of the main flow stream at location I: $M_{m,I}$

Pressure at location I: $p_I$

Air supply pressure: $p_o$

If the angle t, which is the angle between the tapered surface 60 and the axis X, is too large, there will be early flow separation on the surface of the powder feeder head. If separation occurs prior to the powder injection opening provided at the passages 70 (point I and around), it will form a high-pressure region over the injector opening which can decrease the effectiveness of having feed opening in the supersonic region. There is some indication that an angle of 30 degrees can be too much for some applications, whereas smaller than 20 degrees may provide desired results. Decreasing this angle can eliminate separation and can consistently improve flow characteristics. The lower limit is typically bound by manufacturing considerations and the overall length of the apparatus.

As long as flow separation is avoided on the feed entrance location, one-dimensional isentropic relations can provide a good representation of flow characteristics at the feed location. According to these relations, flow pressure at this location is:

$$p_I = \frac{p_o}{\left[1 + \frac{\gamma_m - 1}{2} M_{m,I}^2\right]^{\frac{\gamma_m}{\gamma_m - 1}}}$$

Where $M_{m,I}$ is governed by geometrical features (area ratios) according to this relation:

$$\frac{A_I}{A_S} = \frac{1}{M_{m,I}}\left\{\left(\frac{2}{\gamma_m + 1}\right)\left[1 + \left(\frac{\gamma_m - 1}{2}\right)M_{m,I}^2\right]\right\}^{\frac{\gamma_m + 1}{2(\gamma_m - 1)}}$$

Choice of the angle i very much depends on other design elements. However, it is desirable to design the angle i large enough to direct light particles out of the low-velocity region M, yet not so large as to direct heavy particles to the wall.

The injector head powder opening diameter should be large enough to allow smooth flow of particles. A minimum of 1.0 to 1.5 mm is desirable for some cases. The maximum value for this diameter is determined primarily by manufacturing considerations.

The cross-sectional area As is an important parameter in a cold spray system. It determines the size of the system, the air flow rate and all key performance characteristics of the system. The value of this parameter is primarily selected according to the air supply capacity.

As the components of the nozzle assembly 12 wear during use, the adjustment member 52 can be axially adjusted to a new axial position to maintain the desired area. Furthermore, the adjustment member 52 can be axially positioned based upon desired gas pressures, deposition rates and various materials used.

Although example embodiments have been disclosed, a worker of ordinary skill in this art would recognize that certain modifications would come within the scope of the claims. For that reason, the following claims should be studied to determine their true scope and content.

The invention claimed is:

1. A cold spray nozzle assembly comprising:

a venturi including converging and diverging portions interconnected at a throat;

an air supply conduit in communication with the venturi configured to supply a carrier gas to the converging portion;

a powder feeder in communication with the venturi configured to supply a powdered material to the venturi;

an adjustment member arranged within the venturi and axially movable relative thereto between multiple positions including a desired position, the multiple positions respectively providing multiple different areas including a desired area between the adjustment member and the venturi, desired position providing the desired area;

a retention member maintaining the adjustment member in the desired position;

wherein the adjustment member includes the powder feeder, the adjustment member providing a passage for supplying the powdered material;

wherein the adjustment member includes an end providing the desired area; and wherein the end is tapered.

2. The cold spray nozzle assembly according to claim 1, wherein the end has a rough surface.

3. A cold spray nozzle assembly comprising:

a venturi including converging and diverging portions interconnected at a throat;

an air supply conduit in communication with the venturi configured to supply a carrier gas to the converging portion;

a powder feeder in communication with the venturi configured to supply a powdered material to the venturi;

an adjustment member arranged within the venturi and axially movable relative thereto between multiple positions including a desired position, the multiple positions respectively providing multiple different areas including a desired area between the adjustment member and the venturi, desired position providing the desired area;

a retention member maintaining the adjustment member in the desired position;

wherein the powder feeder includes multiple circumferentially arranged passages located providing injection openings for introducing the powdered material to the venturi, the passages radially offset from a longitudinal axis of the venturi; and wherein the adjustment member includes the powder feeder, the adjustment member providing a passage for supplying the powdered material.

4. The cold spray nozzle assembly according to claim 3, wherein the passages are angled radially outward in the downstream direction.

5. The cold spray nozzle assembly according to claim 3, wherein the passages are directed tangentially with respect to a circumference of the powder feeder.

6. A cold spray nozzle assembly comprising:

a venturi including converging and diverging portions interconnected at a throat;

an air supply conduit in communication with the venturi configured to supply a carrier gas to the converging portion;

a powder feeder in communication with the venturi configured to supply a powdered material to the venturi;

an adjustment member arranged within the venturi and axially movable relative thereto between multiple positions including a desired position, the multiple positions respectively providing multiple different areas including a desired area between the adjustment member and the venturi, desired position providing the desired area;

a retention member maintaining the adjustment member in the desired position; and an orifice body receiving a nozzle tube removably secured to one another, the nozzle tube providing the diverging portion.

7. The cold spray nozzle assembly according to claim 6, wherein a nut secures the orifice body to a gas adapter that provides the air supply conduit.

8. A cold spray nozzle assembly comprising:

a venturi including converging and diverging portions interconnected at a throat;

an air supply conduit in communication with the venturi configured to supply a carrier gas to the converging portion;

a powder feeder in communication with the venturi configured to supply a powdered material to the venturi;

an adjustment member arranged within the venturi and axially movable relative thereto between multiple positions including a desired position, the multiple positions respectively providing multiple different areas including a desired area between the adjustment member and the venturi, desired position providing the desired area;

a retention member maintaining the adjustment member in the desired position; and wherein the adjustment member is threadingly received in the gas adapter and moveable relative thereto to the desired position, and the retention member is a nut locking the adjustment member relative to the gas adapter in the desired position.

9. A method of providing a cold spray nozzle assembly for use comprising the steps of:

a) providing a venturi in communication with an air supply conduit and a powder feed tube;

b) screwing an adjustment member within the venturi between multiple positions including a desired position, the multiple positions respectively providing at least one of multiple different areas and throat clearances including at least one of a desired area and a desired throat clearance between the adjustment member and the venturi; and c) securing the adjustment member in the desired position to maintain the desired area.

10. The method according to claim 9, wherein step a) includes assembling the venturi by securing an orifice body and nozzle tube to one another, the nozzle tube providing a diverging portion.

11. The method according to claim 10, wherein step a) includes hydroforming the nozzle tube.

12. The method according to claim 11, wherein step a) includes fastening the orifice body to a gas adapter using a nut, the gas adapter providing an air supply conduit to the venturi.

13. The method according to claim 9, wherein step c) includes locking the adjustment member in the desired position with a nut.

14. The method according to claim 9, comprising step b) providing powder material through a passage in the adjustment member.

* * * * *